US006776379B2

(12) United States Patent
Sherer et al.

(10) Patent No.: US 6,776,379 B2
(45) Date of Patent: Aug. 17, 2004

(54) CONTAINER WITH ADJUSTABLE LEGS

(75) Inventors: Lanny Sherer, Tiffin, OH (US); Kris Sherer, Pandora, OH (US)

(73) Assignee: Phillips Mfg. and Tower Co., Shelby, OH (US)

( * ) Notice: Subject to any disclaimer, the term of this patent is extended or adjusted under 35 U.S.C. 154(b) by 0 days.

(21) Appl. No.: 10/152,648

(22) Filed: May 20, 2002

(65) Prior Publication Data

US 2003/0150964 A1 Aug. 14, 2003

Related U.S. Application Data

(60) Provisional application No. 60/357,040, filed on Feb. 14, 2002.

(51) Int. Cl.[7] ..... A47G 23/02

(52) U.S. Cl. ..... 248/150; 248/151; 248/152

(58) Field of Search ..... 248/528, 529, 248/136, 146, 150, 151, 519, 408, 188.6, 188.5, 165, 907, 152, 168, 132, 154; 220/628; 47/405

(56) References Cited

U.S. PATENT DOCUMENTS 429,977 A * 6/1890 Thomas
594,491 A * 11/1897 Silverman
952,655 A * 3/1910 Wagner
1,342,807 A * 6/1920 Harrington
1,680,050 A * 8/1928 Keppens
2,503,118 A * 4/1950 Mannix
2,683,014 A 7/1954 Sumen et al.
3,508,666 A * 4/1970 Schwengel
4,438,896 A * 3/1984 Hall ..... 248/523
4,744,536 A * 5/1988 Bancalari ..... 248/125
5,002,252 A * 3/1991 Setala ..... 248/533
5,472,220 A 12/1995 Stephan
5,489,077 A * 2/1996 Stoudt ..... 248/188.7

* cited by examiner

*Primary Examiner*—Gwendolyn Baxter
(74) *Attorney, Agent, or Firm*—David C. Purdue; John C. Purdue

(57) ABSTRACT

A container with brackets secured thereto, for supporting adjustable legs for pivotal movement between a retracted position and an extended position in which they support the container, is disclosed. The container, especially a five gallon bucket, is provided with a plurality of brackets for supporting at least three legs for pivotal movement between a first, retracted position and a second, extended position, with a lock for locking the legs in the extended position. Preferably, the legs comprise telescoping members with locks for locking the members in a variety of relative positions. The brackets have a container sidewall flange, which is positioned against a sidewall of the container, at least one container bottom flange, which is positioned against a bottom of the container, and two leg support flanges, which extend outwardly from the container sidewall flanges and a container.

7 Claims, 2 Drawing Sheets

CONTAINER WITH ADJUSTABLE LEGS

BACKGROUND OF THE INVENTION

1. Field of the Invention

This invention is concerned with containers, especially bucket containers, having adjustable legs secured thereto on special brackets.

2. Description of the Prior Art

Buckets, especially five gallon buckets, are widely distributed nowadays containing a wide variety of products, including a large number of products that are used in the construction and maintenance trades. U.S. Pat. No. 5,472,220 discloses a bucket dolly especially suited for moving around five gallon buckets filled with driveway sealant and spackling compound, for example. Such buckets have also found favor as being useful for storing and transporting tools and other equipment used for a variety of purposes. Tool caddies are even available for use with such buckets. Other containers for tools and the like are also known.

SUMMARY OF THE INVENTION

The present invention is based on the discovery of a container with brackets secured thereto for supporting adjustable legs for pivotal movement between a retracted position and an extended position in which they support the container. The container, especially a five gallon bucket, is provided with a plurality of brackets for supporting at least three legs for pivotal movement between a first, retracted position and a second, extended position, with a lock for locking the legs in the extended position. Preferably, the legs comprise telescoping members with locks for locking the members in a variety of relative positions. The brackets have a container sidewall flange, which is positioned against a sidewall of the container, at least one container bottom flange, which is positioned against a bottom of the container, and two leg support flanges, which extend outwardly from the container sidewall flanges and a container.

Accordingly, it is an object of the present invention to provide a container with adjustable legs supported on brackets for pivotal movement between a first, retracted position and a second, extended position.

It is a further object of the present invention to provide such a container that is highly stable when it is supported by legs secured to the brackets, which, in turn, are secured to the container.

It is still a further object of the invention to provide brackets which will support a container, especially a five-gallon bucket, and that will pivotally support legs.

It is another object of the present invention to provide such container which is easy to assemble and easy to transport.

These and other objects and advantages of this invention will be more fully appreciated by considering the following detailed description, and the illustrations set forth in the drawing.

DETAILED DESCRIPTION OF THE PREFERRED EMBODIMENTS AND BEST MODE

Figure 1:
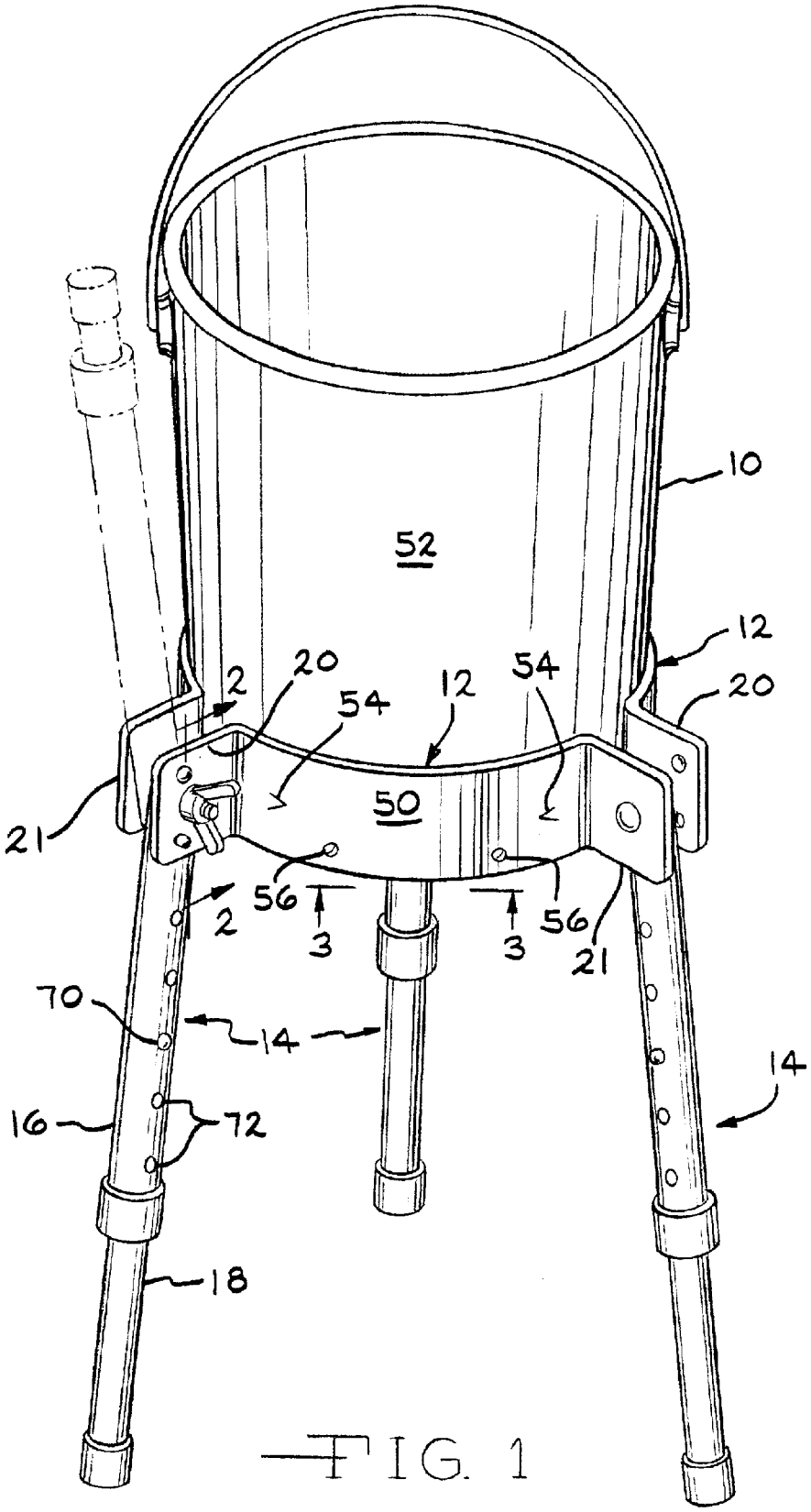
FIG. 1 is a perspective view of a container with brackets secured to it and legs pivotally supported on the brackets.

Referring to FIG. 1, a container in the form of a bucket 10 is supported by brackets 12, which, in turn, support legs 14 for pivotal movement between a first, retracted position (shown in phantom lines for one leg 14 in FIG. 1) and a second, extended position shown in FIG. 1. The legs 14 each have an outer portion 16 and an inner portion 18, which is telescopically received in the outer portion 16.

The outer portions 16 of the legs 14 are pivotally supported between first leg support flanges 20 and second leg support flanges 21 of adjacent brackets 12. The leg flanges 20 and 21 of the brackets 12 extend outwardly from the bucket container 10. A pivot comprising a carriage bolt 22 (FIG. 2) extends through apertures 24 in the outer portion 16 of the leg 14 (FIG. 1), through an aperture 26 (FIG. 2) in the first leg flange 20 of the bracket 12, and through an aperture 28 in the second leg flange 21 of an adjacent bracket 12. A wing nut fastener 30 is secured to one end of the carriage bolt 22 and the other end of the carriage bolt 22 is headed, as indicated at 32. The wing nut 30 is tightened on the carriage bolt 22 so that the outer leg portion 16 is securely held between the leg flanges 20 and 21 of the brackets 12, but not so tight as to cause the outer leg portion 16 to bind. It may be desirable to use a thread locking means to secure the wing nut 30 to the carriage bolt 22 and retain it in a predetermined position.

Figure 2:
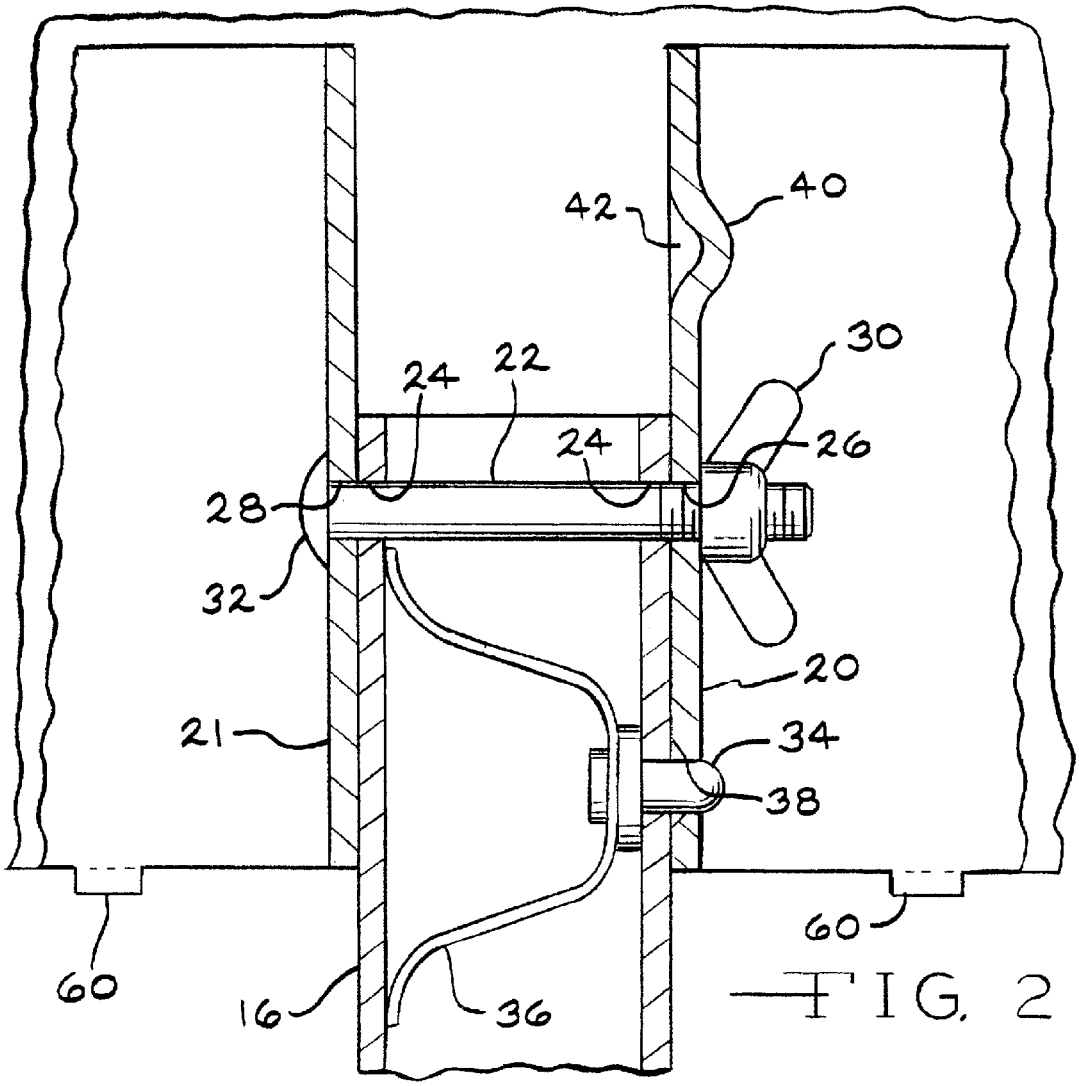
FIG. 2 is a cross sectional view taken along the line 2—2 of FIG. 1.

A spring-loaded button 34, known as a snap button, is supported in the outer portion 16 of the leg 14, as shown in FIG. 2. A spring 36 urges the button 34 to a locking position, as shown in FIG. 2, so that, when the button 34 is aligned with an aperture, indicated at 38, in the leg flange 20 of the bracket 12, the snap button 34 extends through the aperture 38 and locks the outer leg portion 16 against pivoting so that the leg 14 is secured in the second, extended position, shown in FIG. 1. The outer leg portion 16 can be unlocked by depressing the snap button 34, in a known manner, until it disengages from the outer leg portion 16, whereupon the outer leg portion 16 is free to pivot to the first, retracted position (shown in FIG. 1 in phantom lines). It will certainly be appreciated that other locks may be suitably employed in the present invention, to lock the leg 14 in an extended position, including, without limitation, a pin or clevis which passes through openings in the leg flanges 20 and 21 and the outer leg portion 16, which openings align when the leg 14 is in the second position. Other spring loaded locks, which are known in the art may be employed as well. A snap button is preferred and the snap button 34 and the aperture 38 together constitute one of many suitable locks for locking the leg 14 in the second position.

The outer leg portion 16 can be retained in the first, retracted position by engagement between the snap button 34 and a dimple 40, which is formed in the leg portion 20 of the bracket 12. As the outer leg portion 16 pivots to the first, retracted position, it will reach a point where the snap button 34 aligns with a recess, indicated at 42, defined by the dimple 40. The sloping walls, which define the recess 42, will depress the snap button 34 when the outer leg portion 16 is pivoted away from the first, retracted potion, which facilitates the pivoting of the outer leg portion 16 from the first position to the second position. Other suitable means for retaining the leg 14 in the retracted position are known and may be substituted for the retainer comprising the snap button 34 and the dimple 40. Alternatively, the leg 14 may be locked in the retracted position by a lock of a type described in the preceding paragraph.

Referring again to FIG. 1, the brackets 12 are positioned on the bucket container 10, near the bottom thereof. The bracket 12 comprises a container sidewall flange 50, which is configured to abut a sidewall 52 of the container 10. In the embodiment shown in FIG. 1, three identical brackets 12 are positioned around the periphery of the bucket container 10. In producing the assembly shown in FIG. 1, one positions the brackets 12 around the bucket container 10, and connects them together using carriage bolts 22 and wing nut fasteners 30 to connect the leg flange 20 of one bracket 12 to the leg flange 21 of an adjacent bracket 12. At this time, the outer leg portions 16 of the legs 14 would be pivotally supported on the carriage bolts 22, and held captive between the leg flanges 20 and 21 of adjacent brackets 12.

It is preferred that, when the brackets 12 are connected together, as shown in FIG. 1, at least portions of the container sidewall flanges 50 of the brackets 12 frictionally engage the outside of the container sidewall 52. This can be accomplished by sizing the brackets 12, relative to the container 10, and configuring the brackets 12 so that, when the brackets 12 are positioned around the periphery of the container 10, before the carriage bolts are tightened, the leg flanges 20 and 21 are separated by a distance greater than the diameter of the outer leg portion 16. As a consequence, when the wing nut 30 is tightened on the carriage bolt 22, the flanges 20 and 21 will be drawn together and a portion of the sidewall flanges 50, adjacent to the flanges 20 and 21, will be forced against the container sidewall 52.

It is also preferred that, in addition to such frictional engagement, positive engagement be provided as between the container sidewall flange 50 and the container sidewall 52. Such positive engagement may be provided by means of spikes, indicated at 54, which are produced by a punch, or other suitable means, and constitute a pointed flange which projects from the container sidewall flange 50 towards and into the container sidewall 52. Alternatively, fasteners, indicated generally at 56, may be used to positively connect the container sidewall flange 50 of the bracket 12 to the container 10. Such fasteners may comprise rivets, screws, nuts and bolts, or any other suitable fasteners. In either case, such positive engagement between the bracket container sidewall flanges 50 and the container 10 will serve to prevent relative movement between the brackets 12 and the container 10.

Figure 3:
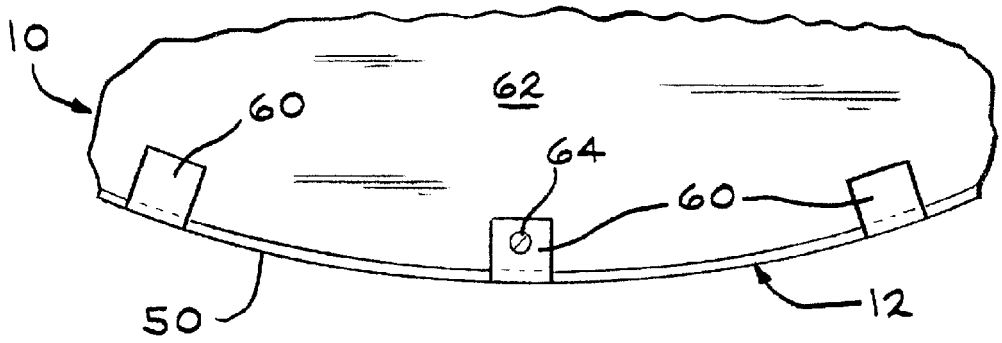
FIG. 3 is a bottom view of a portion of the container and a portion of a bracket, looking in the direction indicated by the arrows 3 in FIG. 1.

According to the preferred embodiment of the present invention, the brackets 12 further comprise container bottom flanges 60 (FIG. 3) which abut a portion of a bottom 62 of the container 10. The container bottom flanges 60 provide positive support for the container 10. In lieu of, or in addition to, fasteners 56 (FIG. 1) or spikes 54, fasteners, indicated generally at 64, may be used to provide positive engagement between the brackets 12 and the container 10. The spikes 54 or the fasteners 56 are preferred, however. When the brackets 12 do include bottom flanges 60 and the legs 14 are in the first, retracted position, the bottom flanges 60 are operable to support the container 10 in an upright position.

In the assembly shown in FIG. 1, the legs 14 comprise telescoping inner leg portions 18 and outer leg portions 16. This provides adjustability for the height at which the bucket container 10 is supported when the legs 14 are in the second, extended position. Each inner leg portion 18 is provided with a snap button 70 which can extend into one of several apertures, indicated at 72, provided in the outer leg portion 16. Such telescoping legs are known and will not be further described herein.

The foregoing detailed description is intended to enable one skilled in the art to practice the present invention, and, also, to set forth the best mode known for practicing the invention, as required by the patent statute. Modifications to the invention, as it is disclosed herein, will undoubtedly occur to those skilled in the art and may yet fall within the spirit and scope of the invention. For example, although the assembly illustrated in FIG. 1 comprises three identical brackets 12, two pairs of two different brackets may be employed. In that case, each bracket would have two identical leg flanges at each end of the bracket. One pair of brackets would have leg flanges corresponding with leg flanges 20, at each end of the bracket, and the other pair of brackets would have leg flanges corresponding with leg flanges 21, at each end of the bracket. These brackets would be positioned alternatingly around the periphery of the bucket, so that each leg would be adjacent to a bracket with a retainer means and a lock means. It will also be appreciated that the brackets according to the principals of the present invention could be modified to have substantially flat or planar container sidewall flanges for use with a box shaped container. In any case, the container sidewall flanges of the brackets should conform to the sidewall of the container. These and other modifications are intended to be within the scope of the present invention.

We claim:

1. An article of manufacture comprising a container having at least one sidewall and a bottom, at least three brackets positioned around the periphery of said container near said container bottom, said brackets comprising a sidewall flange, two leg flanges and a bottom flange and said brackets being secured to said container, at least three legs, said legs being pivotally supported between one of said two leg flanges of one of said brackets and one of said two leg flanges of an adjacent bracket by a pivot for movement between a first, refracted position in which said legs extend upwardly from said brackets and are adjacent to said container sidewall, and a second, extended position in which said legs extend downwardly and outwardly from said container bottom, retainer means for retaining each of said at least three legs in the first position, and lock means for releasably locking each of said at least three legs in the second position wherein, when said legs are in the first position, said bottom flanges of said brackets are operable to support said container in an upright position and wherein, when said legs are in the second position, said legs are operable to support said container in an upright position.

2. The article of manufacture claimed in claim 1 wherein at least one of said two leg flanges of said at least three brackets, and said at least three legs, comprise a retainer constituting said retainer means.

3. The article of manufacture claimed in claim 2 wherein said retainer means comprise a dimple on said at least one of said two leg flanges of said at least three brackets, and further comprise a snap button on said at least three legs.

4. The article of manufacture claimed in claim 3 wherein said lock means comprise an aperture formed in said at least one of said two leg flanges of said at least three brackets, and further comprise said snap button on said at least three legs.

5. The article of manufacture claimed in claim 1 wherein at least one of said two leg flanges of said at least three brackets, and said at least three legs, comprise a lock constituting said lock means.

6. The article of manufacture claimed in claim 2 wherein said at least one of said two leg flanges of said at least three brackets, and said at least three legs, comprise a lock constituting said lock means.

7. An article of manufacture comprising a bucket container having a cylindrical sidewall and a bottom, at least three brackets positioned around the periphery of said container near said bucket bottom, said brackets comprising a sidewall flange, two leg flanges and a bottom flange and said brackets being secured to said bucket, at least three legs, said legs comprising a first end, a second end, a snap button adjacent to said first end and at least two telescoping leg portions, said legs being pivotally supported, adjacent said first end, between one of said two leg flanges of one of said brackets and one of said leg flanges of an adjacent bracket by a pivot for movement between a first, retracted position in which said legs extend upwardly from said brackets and are adjacent to said cylindrical sidewall and a second, extended position in which said legs extend downwardly and outwardly from said bucket bottom, a dimple in one of said two leg flanges of said at least three brackets, and an aperture in one of said two leg flanges of said at least three brackets, wherein, when said legs are in the first position, said snap buttons are operable to engage said dimple and retain said legs in said first position, wherein, when said legs are in the second position, said snap buttons are operable to engage said leg flanges adjacent to the apertures, and lock said legs in the second position, wherein, when said legs are in the first position, said bottom flanges of said brackets are operable to support said container in an upright position and, wherein, when said legs are in the second position, said legs are operable to support said bucket in an upright position.

* * * * *